US011685013B2

(12) United States Patent
Chen et al.

(10) Patent No.: US 11,685,013 B2
(45) Date of Patent: Jun. 27, 2023

(54) POLISHING PAD FOR CHEMICAL MECHANICAL PLANARIZATION

(71) Applicant: Taiwan Semiconductor Manufacturing Company, Ltd., Hsinchu (TW)

(72) Inventors: Chih Hung Chen, Hsinchu (TW); Kei-Wei Chen, Tainan (TW); Ying-Lang Wang, Tien-Chung Village (TW)

(73) Assignee: TAIWAN SEMICONDUCTOR MANUFACTURING COMPANY, LTD., Hsinchu (TW)

( * ) Notice: Subject to any disclaimer, the term of this patent is extended or adjusted under 35 U.S.C. 154(b) by 609 days.

(21) Appl. No.: 16/025,913

(22) Filed: Jul. 2, 2018

(65) Prior Publication Data

US 2019/0224810 A1 Jul. 25, 2019

Related U.S. Application Data

(60) Provisional application No. 62/621,365, filed on Jan. 24, 2018.

(51) Int. Cl.
*B24B 37/26* (2012.01)
*B24B 37/16* (2012.01)
(Continued)

(52) U.S. Cl.
CPC ..... *B24B 37/24* (2013.01); *B24B 37/042* (2013.01); *B24B 37/044* (2013.01); *B24B 37/16* (2013.01); *B24B 37/26* (2013.01)

(58) Field of Classification Search
CPC ..... B24B 37/24; B24B 37/044; B24B 37/26; B24B 37/042; B24B 37/14; B24B 37/16; B24B 37/22
(Continued)

(56) References Cited

U.S. PATENT DOCUMENTS 5,427,566 A * 6/1995 Landi ..... B24D 7/00 451/529
5,435,772 A * 7/1995 Yu ..... B24B 37/22 451/63
(Continued)

FOREIGN PATENT DOCUMENTS

CN 1255080 A 5/2000
CN 1494983 A 5/2004
(Continued)

OTHER PUBLICATIONS

Wei-Tsu Tseng, "A Microreplicated Pad for Tungsten Chemical-Mechanical Planarization," ECS Journal of Solid State Science and Technology, 5 (9) p. 546-p. 552, 2016 7 pages.
(Continued)

*Primary Examiner* — Eileen P Morgan
(74) *Attorney, Agent, or Firm* — Slater Matsil, LLP

(57) ABSTRACT

A polishing pad includes a pad layer and one or more polishing structures over an upper surface of the pad layer, where each of the one or more polishing structures has a pre-determined shape and is formed at a pre-determined location of the pad layer, where the one or more polishing structures comprise at least one continuous line shaped segment extending along the upper surface of the pad layer, where each of the one or more polishing structures is a homogeneous material.

23 Claims, 9 Drawing Sheets

(51) Int. Cl.
*B24B 37/24* (2012.01)
*B24B 37/04* (2012.01)

(58) Field of Classification Search
USPC ..... 451/41, 285, 287, 56, 443, 527, 529
See application file for complete search history.

(56) References Cited

U.S. PATENT DOCUMENTS

| | | | | |
|---|---|---|---|---|
| 5,785,584 | A * | 7/1998 | Marmillion | B24B 37/24 451/283 |
| 5,882,251 | A * | 3/1999 | Berman | B24B 37/26 451/527 |
| 6,019,666 | A | 2/2000 | Roberts et al. | |
| 6,241,596 | B1 * | 6/2001 | Osterheld | B24B 37/26 451/41 |
| 6,331,137 | B1 * | 12/2001 | Raeder | B24B 37/26 451/285 |
| 6,332,830 | B1 * | 12/2001 | Okamura | B24B 37/11 451/36 |
| 6,390,891 | B1 * | 5/2002 | Guha | B24B 37/042 451/287 |
| 6,520,843 | B1 * | 2/2003 | Halley | B24B 9/065 451/285 |
| 6,648,743 | B1 * | 11/2003 | Burke | B24B 37/26 451/526 |
| 7,544,115 | B2 * | 6/2009 | O'Moore | B24B 37/26 451/288 |
| 7,722,437 | B2 | 5/2010 | Ito | |
| 7,985,121 | B2 * | 7/2011 | Lefevre | B24B 37/205 451/6 |
| 8,662,957 | B2 | 3/2014 | Paik et al. | |
| 8,758,659 | B2 * | 6/2014 | Lefevre | B24D 18/00 264/138 |
| 9,415,479 | B2 | 8/2016 | Lin et al. | |
| 9,919,407 | B2 * | 3/2018 | Gottardelli | B24D 11/02 |
| 10,589,399 | B2 * | 3/2020 | Oh | B24B 37/26 |
| 2004/0014413 | A1 * | 1/2004 | Kawahashi | B24B 37/26 451/527 |
| 2011/0183579 | A1 * | 7/2011 | Newelll | B24B 37/205 451/28 |
| 2014/0378035 | A1 * | 12/2014 | Noro | B24B 37/26 451/528 |
| 2016/0236322 | A1 | 8/2016 | Morinaga et al. | |
| 2017/0173758 | A1 * | 6/2017 | Lehuu | B24B 37/22 |
| 2018/0161959 | A1 * | 6/2018 | Wang | B24D 3/346 |
| 2018/0281148 | A1 * | 10/2018 | Lehuu | B24B 37/245 |

FOREIGN PATENT DOCUMENTS

| | | | |
|---|---|---|---|
| CN | 101320708 | A | 12/2008 |
| JP | 3149340 | B2 | 3/2001 |
| JP | 2005001059 | A | 1/2005 |
| TW | 200402098 | A | 2/2004 |
| TW | 200708376 | A | 3/2007 |
| TW | 200930504 | A | 7/2009 |
| TW | 201103695 | A | 2/2011 |
| TW | 201534429 | A | 9/2015 |
| TW | 201536479 | A | 10/2015 |

OTHER PUBLICATIONS

Wei-Tsu Tseng, et al., "Microreplicated CMP Pad for RMG and MOL Metallization," Globalfoundries Fab 10, Hopewell Junction, NY 12533, USA and Dept. of Chemical Eng., Clarkson University, Potsdam, NY 13699, USA, 3 pages.

* cited by examiner

POLISHING PAD FOR CHEMICAL MECHANICAL PLANARIZATION

PRIORITY CLAIM AND CROSS-REFERENCE

This application claims priority to U.S. Provisional Patent Application No. 62/621,365, filed Jan. 24, 2018, entitled "Polishing Pad for Chemical Mechanical Planarization," which application is hereby incorporated by reference in its entirety.

BACKGROUND

The semiconductor industry has experienced rapid growth due to continuous improvements in the integration density of a variety of electronic components (e.g., transistors, diodes, resistors, capacitors, etc.). For the most part, this improvement in integration density has come from repeated reductions in minimum feature size, which allows more components to be integrated into a given area.

Chemical mechanical planarization (CMP) has become an important semiconductor manufacturing process since its introduction in the 1980s. An example application of the CMP is the formation of copper interconnect using the damascene/dual-damascene process, where the CMP is used to remove metal (e.g., copper) deposited outside trenches formed in a dielectric material. The CMP process is also widely used to form a planar device surface at various stages of semiconductor manufacturing, since the photolithography and etching process used to pattern the semiconductor devices may need a planar surface to achieve the targeted accuracy. As the semiconductor manufacturing technology continues to advance, better CMP tools are needed to meet the more stringent requirements of advanced semiconductor processing.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

The following disclosure provides many different embodiments, or examples, for implementing different features of the invention. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 1A:
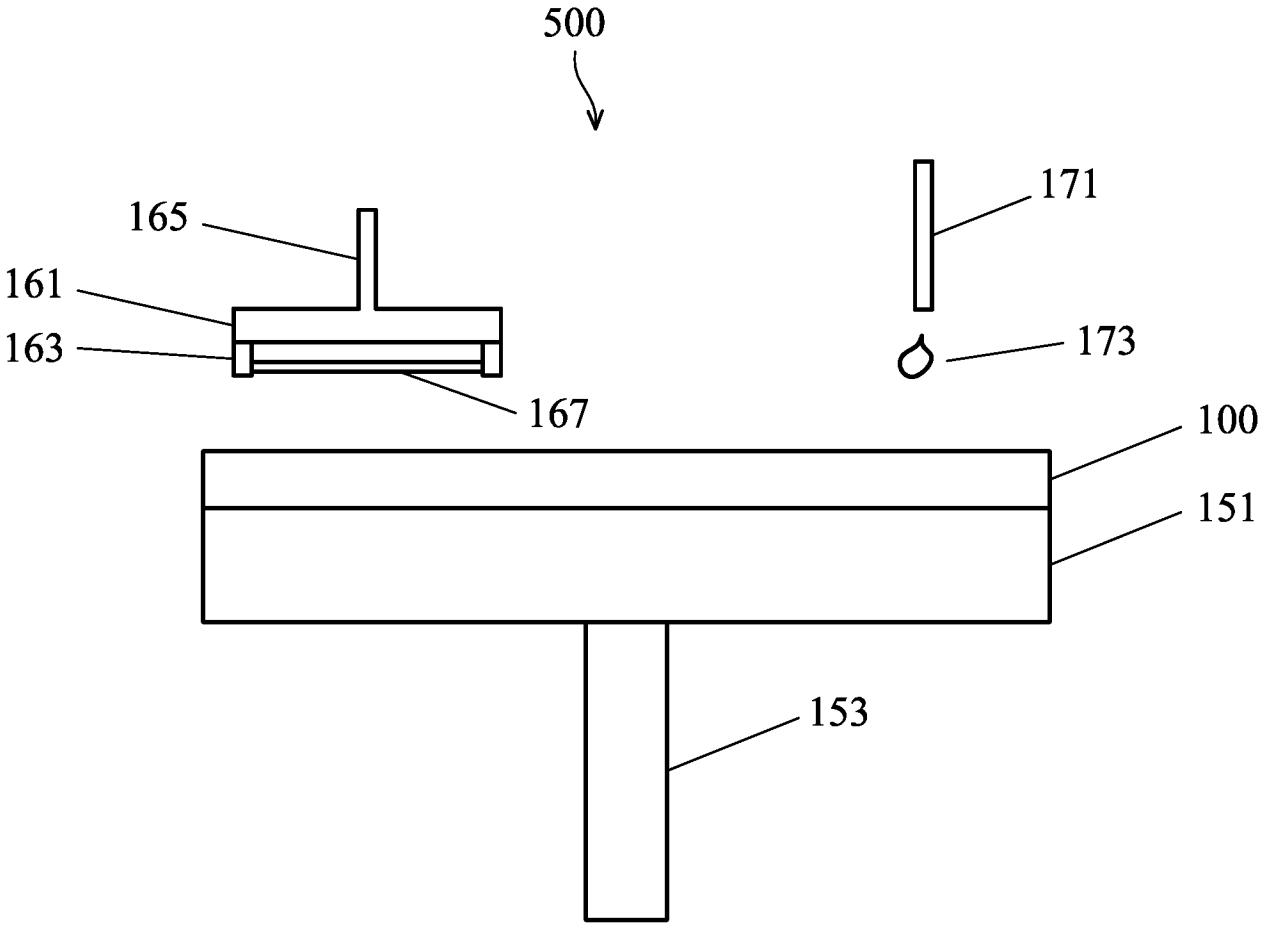
FIG. 1A illustrates a cross-sectional view of a CMP tool used in semiconductor processing, in accordance with some embodiments.

FIG. 1A illustrates a cross-sectional view of a CMP tool 500 used for a CMP process, in accordance with some embodiments. The CMP tool 500 may also be referred to as a polishing station. Note that for clarity, not all features of the CMP tool 500 are illustrated. As illustrated in FIG. 1A, the polishing station 500 has a platen 151, a polishing pad 100 attached to an upper surface of the platen 151, and an axle 153 attached to a bottom surface of the platen 151. The axle 153 is driven by a driving mechanism (e.g., motor, not shown) to rotate the platen 151 and the polishing pad 100. Details of the polishing pad 100 are discussed hereinafter.

FIG. 1A also illustrates a carrier 161, a retaining ring 163 attached to a lower side of the carrier 161, and an axle 165 attached to an upper side of the carrier 161. A wafer 167, which is to be polished by the polishing pad 100, is retained by the retaining ring 163. The axle 165 is driven be a driving mechanism (e.g., motor, not shown) to rotate the carrier 161, the retaining ring 163 and the wafer 167. The wafer 167 and the polishing pad 100 may rotate in a same direction (e.g., clockwise, or counter clock wise), or in different directions. In other embodiments, only the polishing pad 100 is rotated during the CMP process, and the wafer is not rotated during the CMP process.

During the CMP process, the carrier 161 is lowered toward the polishing pad 100, such that the lower surface of the wafer 167 is in physical contact with upper surfaces of the polishing structures 105 (see FIG. 2A) of the polishing pad 100. A pressure is maintained between the wafer 167 and the polishing pad 100 such that the wafer 167 is firmly pressed against the polishing pad 100 during the CMP process. A chemical solution 173, known as slurry, is dispensed onto the surface of the polishing pad 100 by a dispensing tool 171 to aid the planarization process. Thus, the surface of the wafer 167 may be planarized using a combination of mechanical (grinding by abrasives in the slurry) and chemical (etching by etchants in the slurry) forces. In the example of FIG. 1A, the polishing pad 100 is larger (e.g., having a larger diameter) than the wafer 167. For example, to polish a 300 mm wafer, the polishing pad 100 may have a diameter of 760 mm.

Figure 1B:
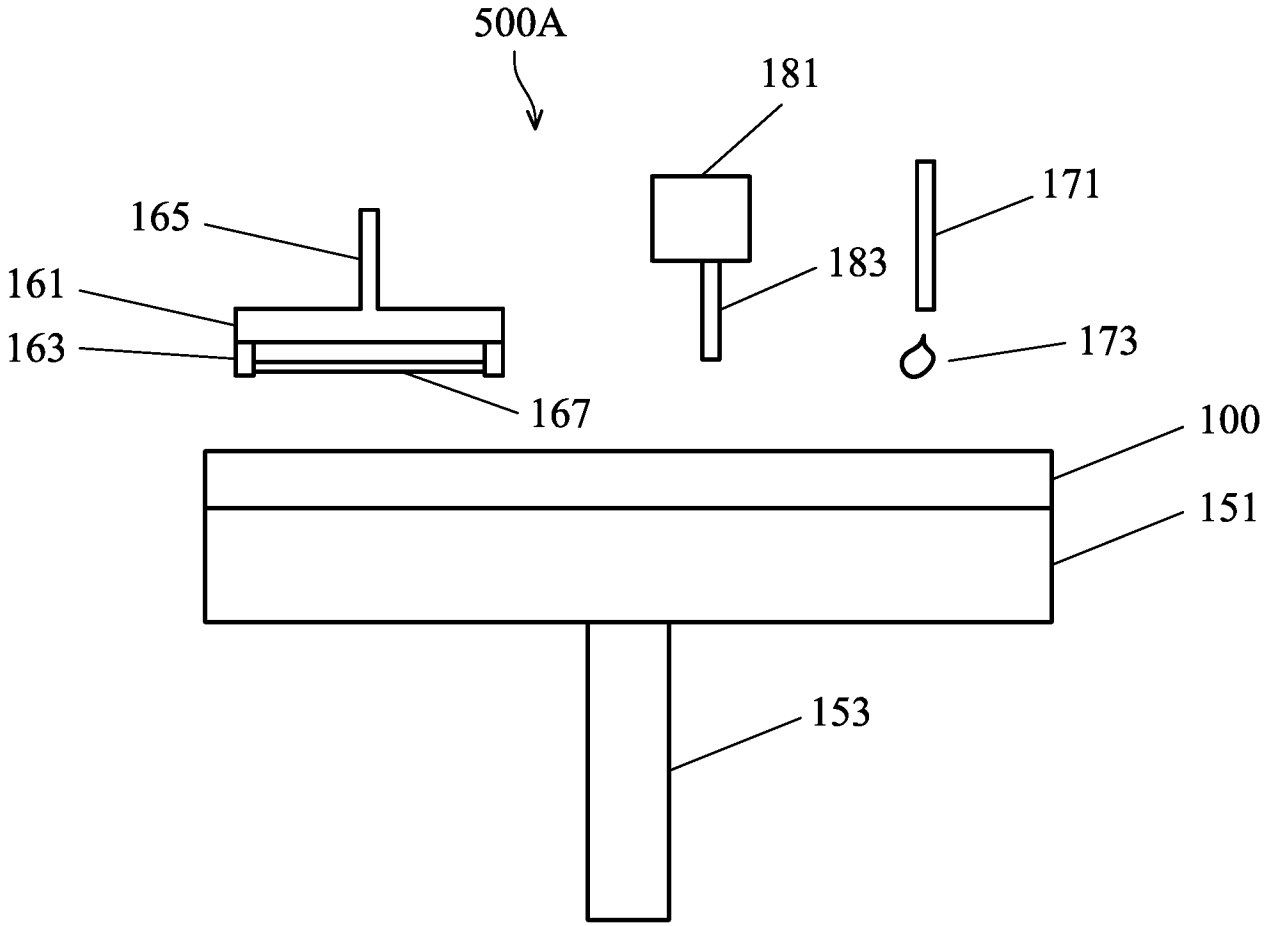
FIG. 1B illustrates a cross-sectional view of a CMP tool used in semiconductor processing, in accordance with some embodiments.

FIG. 1B illustrates a cross-sectional view of a CMP tool 500A used for a CMP process, in accordance with some embodiments. Same references numerals in FIGS. 1A and 1B refer to the same or similar elements, thus details are not repeated. The CMP tool 500A is similar to the CMP tool 500 of FIG. 1A, but with additional features. Particularly, the CMP tool 500A further includes a machining tool 181 with a bit 183. The bit 183 may be any suitable bit (e.g., a drilling bit, a cutting bit) for performing the machining operations, such as drilling, boring, reaming, milling, cutting, or the like. Depending on the machining operations to be performed, different bits may be attached to the machining tool 181 for different intended machining operations. In some embodiments, the machining tool 181 is used to form the polishing pad 100, details of which are discussed in details with reference to FIG. 8. In addition, the machining tool 181 is also used to re-condition the surface of the polishing pad 100, as discussed hereinafter, in some embodiments. Discussions herein regarding forming the polishing pad 100 may refer to the use of the machining tool 181 of the CMP tool 500A, this is merely for illustration purpose and not limiting. It is understood that the polishing pad 100 may be formed outside the CMP tool (e.g., 500) using a machining tool separate from the CMP tool.

Figure 2A:
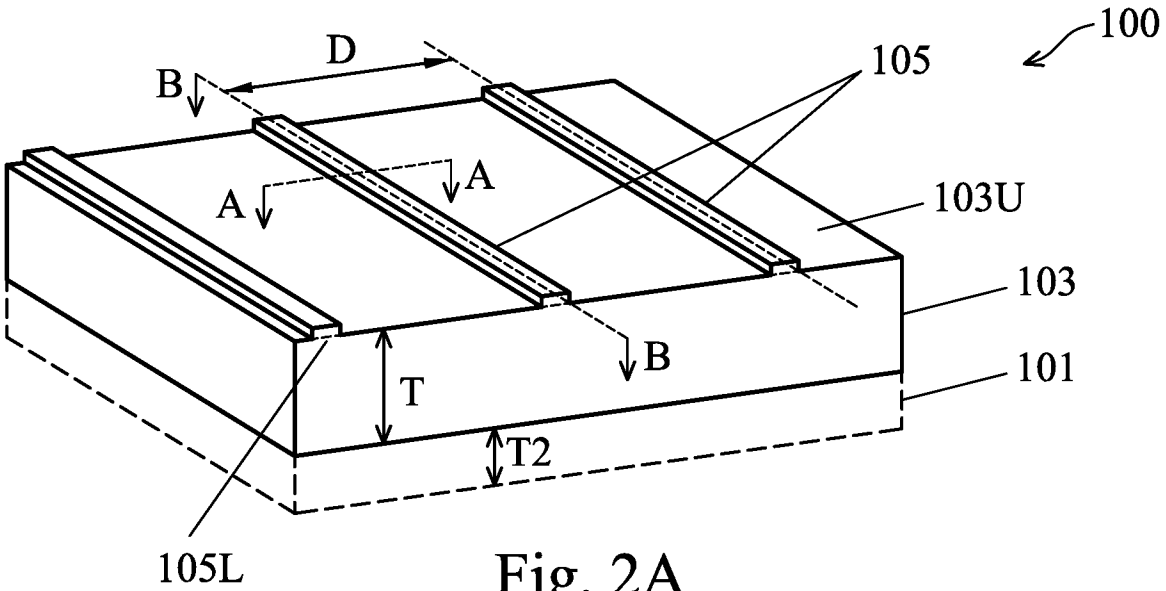
FIGS. 2A-2D illustrate various views of a polishing pad, in accordance with an embodiment.
Figure 2B:
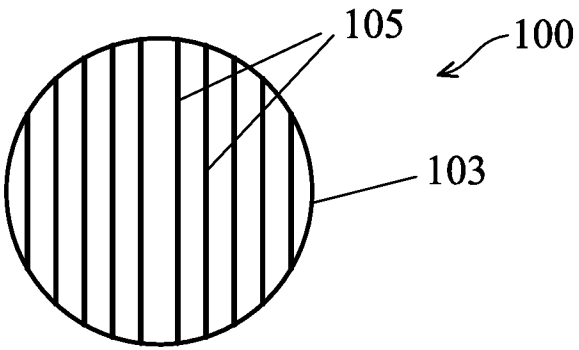

FIGS. 2A-2D illustrate various views (e.g., perspective view, cross-sectional view, and plan view) of the polishing pad 100, in accordance with an embodiment. FIG. 2A illustrates a perspective view of a portion of the polishing pad 100, and FIG. 2B illustrates a plan view of the polishing pad 100 of FIG. 2A. As illustrated in FIG. 2A, the polishing pad 100 comprises a pad layer 103 and a plurality of polishing structures 105 over an upper surface 103U of the pad layer 103. FIG. 2A further illustrates an optional support layer 101 underlying the pad layer 103.

The pad layer 103 is formed of a suitable material such as a thermosetting plastic. In some embodiments, a hardness (e.g., Shore D scale) of the pad layer 103 is between about 10 and about 80. Example materials of thermosetting plastics includes, e.g., epoxy resin, polyurethane, polyester resin, and polyimides. The pad layer 103 is a solid piece of a bulk material, e.g., a non-porous material having a substantially uniform composition throughout, in the illustrated example of FIG. 2A. In other embodiments, the pad layer 103 is formed of a porous material. In some embodiments, the pad layer 103 is formed of polyurethane. The polishing structures 105 comprises a plurality of structures protruding from the upper surface 103U of the pad layer 103, where the plurality of structures have pre-determined shapes and sizes, and are formed at pre-determined locations over the pad layer 103. FIG. 2A illustrates the interfaces 105L (see also FIG. 2C) between the polishing structures 105 and the pad layer 103. Note that the interfaces 105L, illustrated as dashed lines, may represent the boundaries (e.g., partitions) between the polishing structures 105 and the pad layer 105, which boundaries may not physically exist, but rather are logic boundaries for partitioning.

In the example of FIG. 2A, the polishing structures 105 are strip shaped. In other words, each polishing structure 105 has the shape of a rectangular prism. The polishing structures 105 are parallel to each other in FIG. 2A. Therefore, in the top view of FIG. 2B, the polishing structures 105 are illustrated as a plurality of parallel strips that extend across the surface of the pad layer 103. A pitch, or a distance D (see FIG. 2A), between two adjacent polishing structures 105 in FIGS. 2A and 2B may be between about 1 mm and about 10 mm, such as about 2 mm, although other dimensions are also possible.

In an exemplary embodiment, the polishing structures 105 are formed of a same material as the pad layer 103, and may be formed by removing portions of the pad layer 103. The polishing structures 105 are formed using machining techniques, in some embodiments. Details regarding the process for forming the polishing pad 100 having the polishing structures 105 are discussed hereinafter with reference to FIG. 8.

FIG. 2A further illustrates an optional support layer 101. The support layer 101, if formed, comprises a suitable material (e.g., foam) to provide support for the pad layer 103. In some embodiments, the pad layer 103 is formed of a hard material (e.g., a thermosetting plastic), and the support layer 101 is formed of a more flexible material (e.g., foam) to ensure a good contact between the polishing structures 105 and the wafer 167 (see, e.g., FIG. 1A) across the whole surface of the wafer 167 during the CMP process. In some embodiments, the polishing pad 100 has a two-layered structure, with the support layer 101 underlying the pad layer 103. The pad layer 103 may have a thickness T between about 0.5 mm and about 5 mm, such as 2 mm, and the support layer 101 may have a thickness $T_2$ between about 0.5 mm and about 5 mm, e.g., about 1.3 mm. In other embodiments, the support layer 101 is omitted, and the polishing pad 100 comprises the pad layer 103 with the polishing structures 105. For simplicity, the support layer 101 is not illustrated in subsequent figures, with the understanding that the support layer 101 may be formed under the pad layer 103.

As illustrated in FIG. 2B, the pad layer 103 of the polishing pad 100 has a circular shape. A diameter of the pad layer 103 is larger than a diameter of the wafer to be polished, in some embodiments. For example, to polish 300 mm wafers, the diameter of the pad layer 103 may be, e.g., around 760 mm. The support layer 101, if formed, has a circular shape with a same size as the pad layer 103, in some embodiments. Therefore, in the plan view of FIG. 2B, the perimeter of the support layer 101 (if formed) overlaps (e.g., completely overlaps) with the perimeter of the pad layer 103.

Figure 2D:
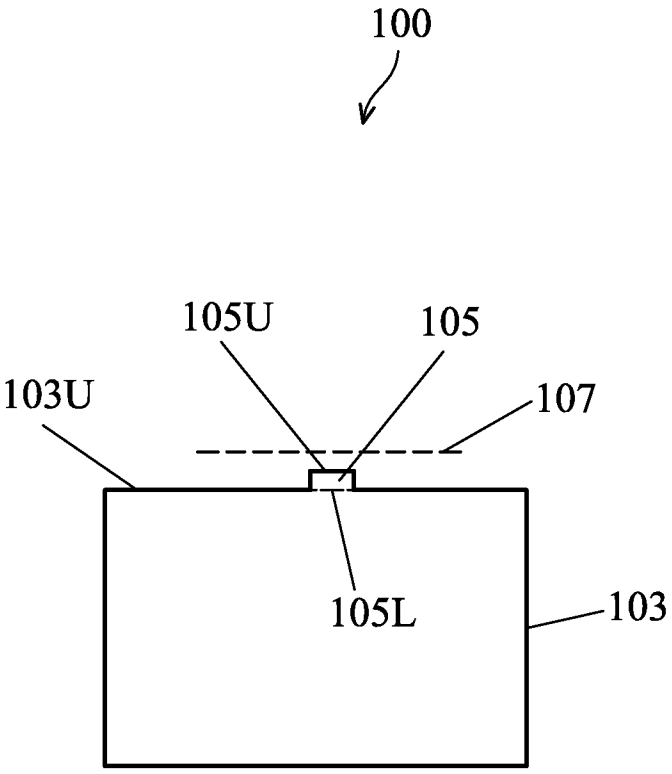
Figure 2C:
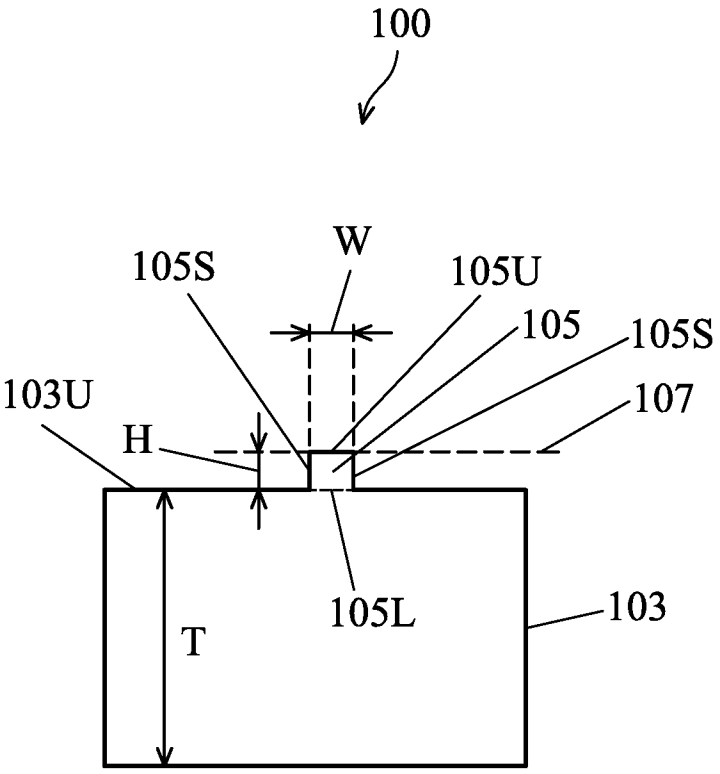

FIG. 2C illustrates a cross-sectional view of a portion of the polishing pad 100 along cross-section A-A in FIG. 2A. For simplicity, only one polishing structure 105 is illustrated in FIG. 2C. In the example of FIG. 2C, after being formed, the polishing structure 105 (e.g., a newly formed polishing structure) has a width W between about 0.5 mm and about 5 mm, and a height H between about 0.05 mm and about 1 mm. In some embodiments, a contact ratio of the polishing pad 100, defined as a ratio between a contact area (e.g., a sum of the areas of the upper surfaces 105U of all of the polishing structures 105) of the polishing pad 100 to a surface area of the polishing pad 100, is between about 1% and about 10%, where the surface area of the polishing pad 100 is the area of the circular shape in FIG. 2B.

FIG. 2D illustrates the polishing pad 100 shown in FIG. 2C, after the polishing structure 105 has been worn out after extensive use to polish wafers. As illustrated in FIG. 2D, the upper surface 105U of the polishing structure 105, which was at a level indicated by a line 107 (see FIG. 2C) when newly formed, is recessed below the line 107 after being worn out. In other words, the height H of the polishing structure 105 is reduced when worn out. However, the cross-section of the polishing structure 105 is still a rectangle, and the width W of the polishing structure 105 remains substantially unchanged. In other words, the area of the upper surface 105U of each of the polishing structures 105 remains substantially unchanged even when the polishing structure 105 is worn out. As a result, the contact ratio of the polishing pad 100 remains substantially the same regardless of the condition (e.g., new or worn-out) of the polishing pad 100.

The substantially constant contact area of the polishing structure 105 (thus substantially constant contact ratio of the polishing pad 100) provides a substantially constant polishing rate, and there is no need to frequently re-condition the surface of the polishing pad 100. In some embodiments, the polishing pad 100 can polish multiple (e.g., more than 100) wafers before surface re-conditioning is needed. In some embodiments, there is no need for pad surface re-conditioning throughout the life of the polishing pad 100. Compared with a conventional polishing pad, where the surface of the conventional polishing pad needs to be re-conditioned frequently, e.g., after polishing each wafer, the presently disclosed polishing pads (e.g., 100, and 100A-100D discussed hereinafter with reference to FIGS. 3-6) greatly simplify the semiconductor processing flow and lower the operation/maintenance cost.

The number, the shape, and the size of the polishing structures 105 illustrated in FIGS. 2A-2D are for illustration purpose and are not limiting. Other shapes, sizes, and other numbers of polishing structures are also possible and are fully intended to be included within the scope of the present disclosure. Additional embodiments of the polishing pad with polishing structures of different shapes are illustrated in FIGS. 3-6.

FIGS. 3-6 each illustrates a plan view of a polishing pad (e.g., 100A, 100B, 100C, or 100D), in accordance with some embodiments. In some embodiments, regardless of the shape of the polishing structures 105 in the plan view, the cross-section of each of the polishing structures 105 in FIGS. 3-6 (e.g., taken along cross-section C-C in each of the FIGS. 3-6) are rectangular shaped (e.g., same or similar to FIG. 2C) to provide a substantially constant contact area, regardless of the condition (e.g., new or worn-out) of the polishing pad (e.g., 100A, 100B, 100C, or 100D), similar to the discussion above with reference to FIGS. 2C and 2D. In FIGS. 3-6, the materials and the formation methods of the pad layer 103 and the polishing structures 105 may be the same as or similar to those of FIGS. 2A-2C. Furthermore, the width, and/or the height of the polishing structures 105 of the polishing pads 100A-100D may be the same as or similar to those of the polishing structures 105 of the polishing pad 100, and the contact ratio of the polishing pads 100A-100D may be the same as or similar to that of the polishing pad 100.

Figure 3:
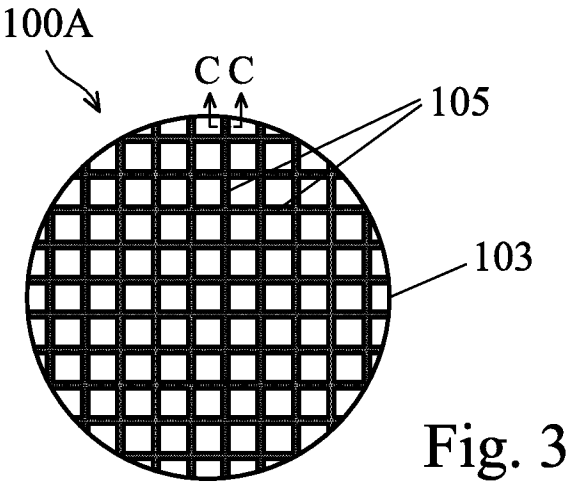

In FIG. 3, the polishing structures 105 of the polishing pad 100A comprise a plurality of grid shaped structures protruding from the upper surface of the pad layer 103. In other words, the polishing structures 105 comprise a first plurality of strips (e.g., rectangular prisms) that are parallel to each other and extend across the surface of the pad layer 103 along the horizontal direction of FIG. 3. The polishing structures 105 further includes a second plurality of strips (e.g., rectangular prisms) that are parallel to each other and extend across the surface of the pad layer 103 along a direction perpendicular (e.g., along the vertical direction of FIG. 3) to the first plurality of strips. Therefore, each of the strips of the polishing structures 105 has a length (measured along a longitudinal direction of the strip) in the order of tens of millimeters or hundreds of millimeters, such as between about 10 mm and about 760 mm. A pitch between two adjacent parallel strips may be between about 1 mm and about 10 mm, although other dimensions are also possible.

Figure 4:
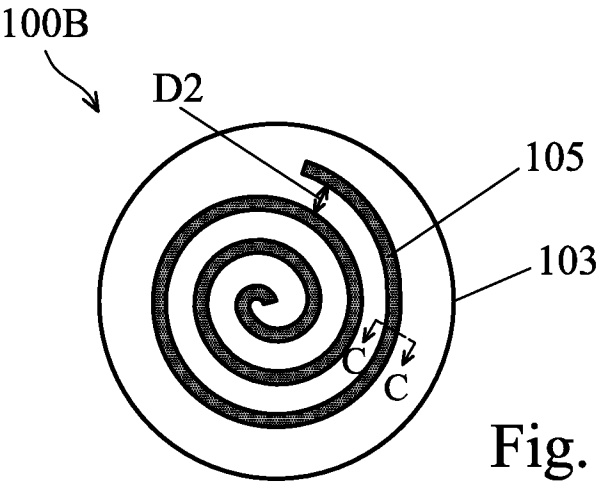
FIGS. 3-6 each illustrates a plan view of a polishing pad, in accordance with some embodiments.

In FIG. 4, the polishing structure 105 of the polishing pad 100B comprises a spiral-shaped structure protruding from the upper surface of the pad layer 103. The spiral-shaped structure is a structure that extends continuously from edge regions of the pad layer 103 to center regions of the pad layer 103. Therefore, an end-to-end length of the spiral-shaped polishing structure 105, measured along the spiral shape, may be tens of meters, hundreds of meters, or even longer (e.g., between about 10 m and about 500 m). A distance $D_2$ between two adjacent parallel segments is between about 1 mm and about 10 mm, although other dimensions are also possible.

Figure 5:
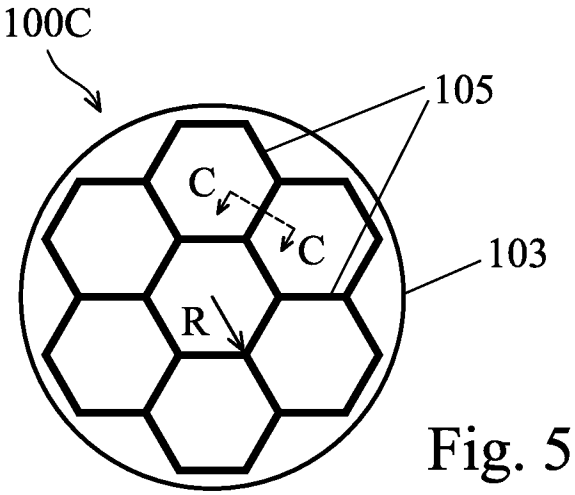

In FIG. 5, the polishing structures 105 of the polishing pad 100C comprise a plurality of honeycomb shaped structures protruding from the upper surface of the pad layer 103. In some embodiments, a radius R of each of the honeycombs (e.g., a hexagon) is between about 1 mm and about 10 mm, although other dimensions are also possible. Besides a hexagon, other polygon shapes, such as a triangle, a pentagon, an octagon, or the like, may also be used for the polishing structure 105. These and other variations are fully intended to be included within the scope of the present disclosure.

Figure 6:
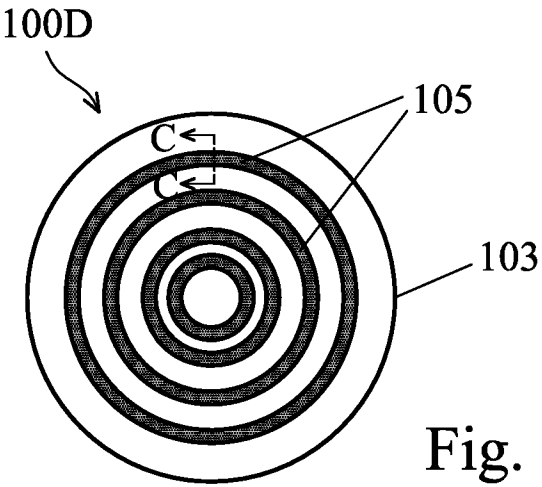

In FIG. 6, the polishing structures 105 of the polishing pad 100D comprise a plurality of concentric circle shaped structures protruding from the upper surface of the pad layer 103. The circumference of these concentric circles may be between about 0.05 m and about 2.4 m, depending on the size of the pad layer 103. A pitch between two adjacent circles may be between about 1 mm and about 10 mm, although other dimensions are also possible.

FIGS. 3-6 are merely examples and not intended to be limiting. Other variations are possible and are fully intended to be included within the scope of the present disclosure. For example, the number of honeycomb shaped structures, or the number of concentric circle shaped structures may be different from what was illustrated, depending on, e.g., the size of the polishing pad. Any suitable shape, size, and location of the polishing structure 105 that provide pre-determined, consistent, and repeatable asperity for the polishing pad may be used.

There are many advantages for the various embodiments of polishing pad disclosed herein. By design, the polishing structures 105 have pre-determined shapes, sizes and are formed at per-determined locations of the polishing pad (e.g., 100, 100A, 100B, 100C, or 100D). This, coupled with the substantially constant contact area between the polishing pad and the wafer (see, e.g., discussion above with reference to FIGS. 2C-2D) regardless of the condition of the polishing pad, provide a polishing pad with predictable and repeatable surface asperity. The repeatable asperity allows for significantly improved uniformity of the CMP process both within a wafer and from wafer to wafer.

To fully appreciate the advantage of the presently disclosed polishing pads with polishing structures 105, a comparison with a first reference design is instrumental. In the first reference design, the surface asperity of the polishing pad is achieved through a combination of pad porosity and diamond cutting. In particular, the polishing pad of the first reference design is made of a porous material. The holes in the polishing pad makes it easier to perform a diamond cutting process, which is performed to create surface asperity for the first reference design. In the diamond cutting process, a diamond disk covered with thousands of randomly oriented diamonds is used to cut a surface of the porous polishing pad, resulting in peaks and valleys in the surface of the polishing pad. The peaks define the surface asperity of the polishing pad of the first reference design. The valleys acts as reservoirs for the polishing slurry used in the CMP process. Note that the number of peaks, the size of the peaks, and the location of the peaks are random due to the diamond cutting, and therefore, the surface asperity of the polishing pad of the first reference design are random and not repeatable.

An issue with the polishing pad of the first reference design is that the sizes (e.g., width) of the peaks are small (e.g., in the order of several microns). Peaks having such small sizes, when used to polish wafers (see wafer 167 in FIG. 7A) having surface non-planarity, may extends into the recesses (see 117 in FIG. 7A) between high surface portions (see 115 in FIG. 7A) and may polish (e.g., remove, or recess) the low surface portions (see 119 in FIG. 7A) of the wafer. This causes the low surface portions to recess even further, thus worsening the non-planarity of the wafer.

Figure 7A:
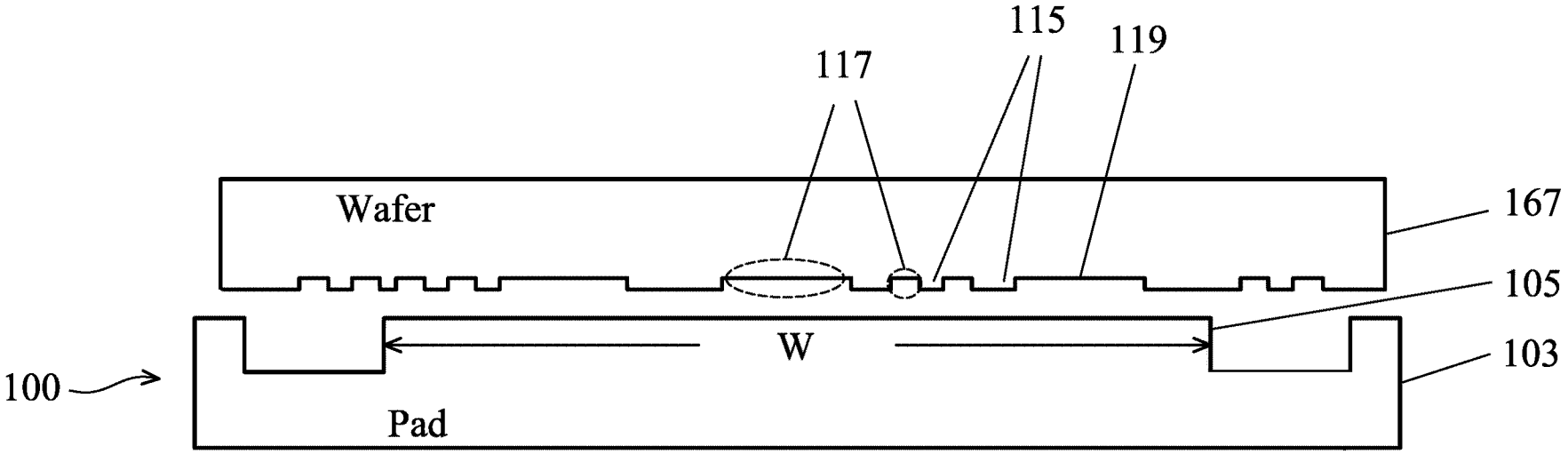
FIG. 7A is a cross-sectional view illustrating the planarization of a wafer using a polishing pad, in accordance with an embodiment.

Referring to FIG. 7A, which illustrates a cross-sectional view of a portion of the polishing pad 100 of FIG. 2A along cross-section A-A, FIG. 7A also illustrates a portion of the wafer 167 to be polished by the polishing pad 100. The wafer 167 has high surface portions 115 and low surface portions 119. Recesses 117 are defined by adjacent high surface portions 115. A width of the recess 117 is typically in the order of microns (e.g., several microns wide). As discussed above, the width W (see also FIG. 2C) of the polishing structure 105 may be between about 0.5 mm to about 5 mm. Therefore, compared with the widths of the recesses 117 (e.g., in a range between nanometers and microns, such as a few microns) on the surface of the wafer 167, the size of the polishing structure 105 is orders of magnitude larger. In some embodiments, a smallest dimension (e.g., width, height, length) of the polishing structures 105 of the presently disclosed polishing pads (e.g., 100, 100A-100D) is larger than about 0.01 mm (e.g., the height H of the polishing structure 105 is between about 0.05 mm and 1 mm). In some embodiments, each of the polishing structures 105 of the polishing pad (e.g., 100, 100A-100D) has a length and a width, where the length is at least ten times of the width. In the illustrated embodiments, each of the polishing structures 105 of the polishing pad (e.g., 100, 100A-100D) has at least one continuous line shaped (e.g., straight line, or curved line) segment that extends parallel to the upper surface 103U of the pad layer 103, where a length of the line shaped segment, measured along a longitudinal direction of the line shaped segment, is in the order of tens of millimeters, hundreds of millimeters, meters, or longer. For example, each of the strips of the polishing structures 105 in FIG. 3 has a length between about 10 mm and 760 mm, and the spiral-shaped polishing structure 105 in FIG. 4 has a length between about 10 m and 500 m. As a result, the polishing structures 105 bridge across the recess 117 of the wafer 167, and will not extend into the recesses 117 to further recess the low surface portions 119. Therefore, the polishing structures 105 of the polishing pad 100 recesses (e.g., polishes) the high surface portions 115 to increase the planarity of the wafer 167, and to reduce dishing and erosion of the wafer 167. Similar advantages are achieved by other embodiment polishing pads, such as the polishing pads 100A-100D.

Figure 7B:
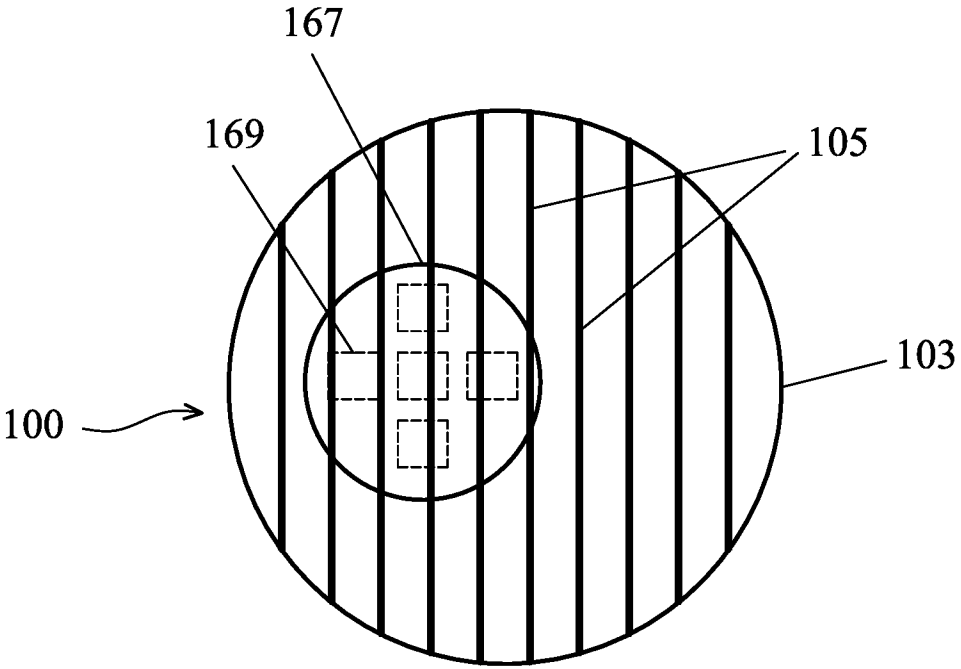
FIG. 7B is a plan view illustrating the wafer and the polishing pad of FIG. 7A during wafer polishing, in accordance with an embodiment.

FIG. 7B is a plan view illustrating the wafer 167 and the polishing pad 100 of FIG. 7A during wafer polishing, in accordance with an embodiment. Note that while FIG. 7A illustrates a portion of the wafer 167 and a portion of the polishing pad 100, FIG. 7B illustrates the whole polishing pad 100 (e.g., a 700 mm polishing pad), and the whole wafer 167 (e.g., a 300 mm wafer) having a plurality of semiconductor dies 169 (may also be referred to as semiconductor chips or dies, illustrated in phantom in FIG. 7B) formed thereon. In the example of FIG. 7B, due to the large dimension (e.g., length) of the polishing structures 105, each of the polishing structures 105 may extend across the boundaries (e.g., exterior perimeters) of one or more dies 169 on the wafer 167 during the CMP process. FIG. 7B uses the polishing pad 100 as an example, other polishing pads, such as the polishing pads 100A-100D, may also be used, and the corresponding polishing structures 105 may extend across the boundaries of one or more dies 169 on the wafer 167 during the CMP process.

Another issue with the polishing pad of the first reference design is the durability of the micron-sized random peaks on the polishing pad. These random peaks generated by the diamond cutting process have sharp tips (e.g., triangular shaped peaks) that can quickly dull, resulting in lower wafer polishing rate. Therefore, the polishing pad of the first reference design needs frequent refreshing (e.g., surface re-conditioning) by the diamond cutting process during the semiconductor fabrication process. The frequency of refreshing is typically once every wafer (e.g., after every wafer polish), or in parallel with (e.g., during) each wafer polishing process. However, the diamond cutting process may generate pad defects, or may stir up polishing debris, resulting in wafer defects. The frequent refreshing of the polishing pad also results in high operation/maintenance cost, and longer production time.

As discussed above with reference to FIGS. 2C and 2D, the polishing structures 105 of the presently disclosed polishing pad (e.g., 100, 100A-100D) are able to maintain a substantially constant contact area between the wafer and the polishing pad, regardless of the condition (e.g., new or worn-out) of the polishing pad. There is no need for frequent pad surface refreshing. In some embodiments, there is no need for pad surface re-conditioning throughout the life of the polish pads (e.g., 100, 100A-100D). Therefore, the presently disclosed polishing pads (e.g., 100, 100A-100D) greatly simplify the semiconductor manufacturing process and lower the operation/maintenance cost.

A third issue of the first reference design is the non-repeatability of the surface asperity of the polishing pad. After the polishing pad is re-conditioned by the diamond cutting process, the surface asperity of the polishing pad of the first reference design is different from the previous surface asperity, due to the random peaks generated by the diamond cutting process. The randomness of the peaks results in CMP non-uniformity from wafer to wafer. In addition, the lot-to-lot variation of the polishing pad and variation in the diamond disk, due to manufacturing variations, worsen the non-repeatability of the pad surface asperity of the first reference design. Furthermore, as the same diamond disk used to re-condition the surface of the polishing pad gets worn out, the change in the condition of the diamond disk further contributes to the randomness and the non-repeatability of the surface asperity of the polishing pad of the first reference design.

In contrast, the polishing structures 105 of the presently disclosed polishing pads (e.g., 100, 100A-100D) have pre-determined shapes, pre-determined sizes, and are formed at pre-determined locations. Coupled with the ability of the polishing structures 105 to maintain substantially constant contact area regardless of the condition of the polishing pad, the presently disclosed polishing pads achieve repeatable surface asperity, thus providing improved CMP uniformity within a wafer and from wafer to wafer.

Figure 8:
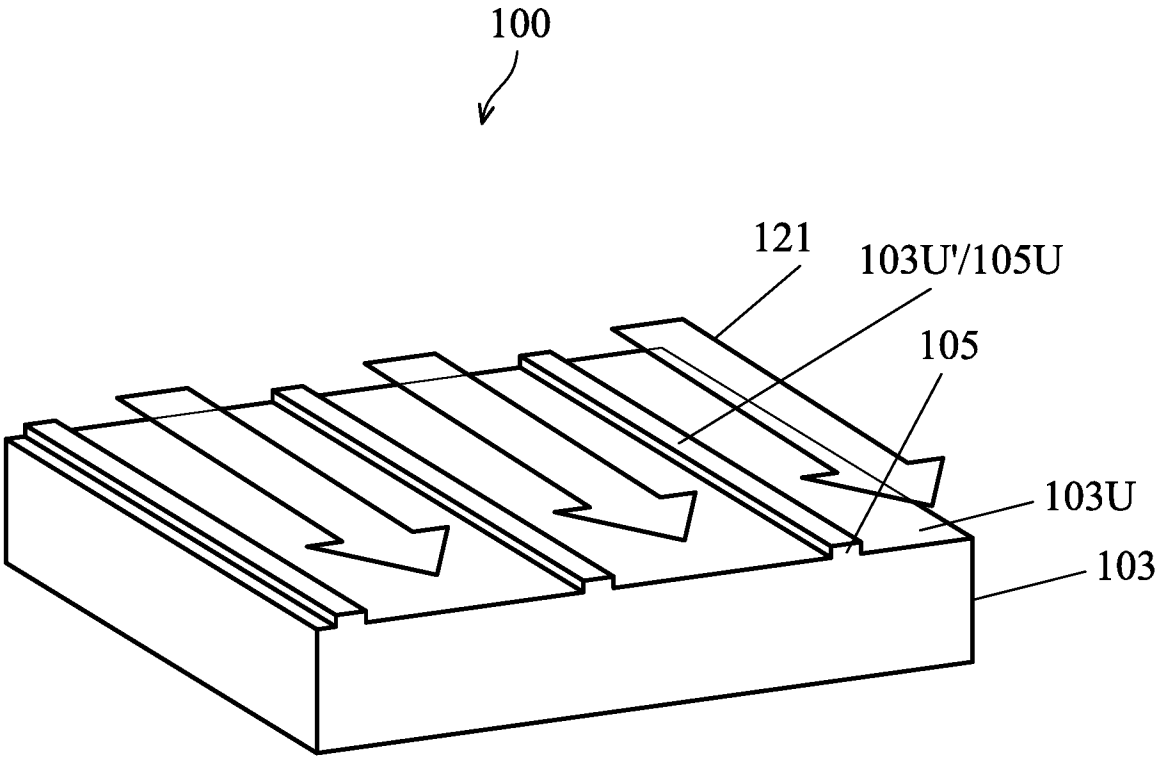
FIG. 8 illustrates a perspective view of a polishing pad, in accordance with an embodiment.

FIG. 8 illustrates the formation of a polishing pad (e.g., 100, 100A-100D) using machining techniques (e.g., subtractive machining techniques). Unlike the diamond cutting process (e.g., using the diamond disk), the machining techniques use one or more machining tools to remove portions of the pad layer 103 at pre-determined locations. For clarity, only a portion of the polishing pad is illustrated in FIG. 8, and the machining tool (e.g., 181 in FIG. 1B) is not illustrated. In some embodiments, the formation of the polishing pad is performed outside the CMP tool (e.g., 500) using a machining tool separate from the CMP tool. In other embodiments, the formation of the polishing pad is performed in the CMP tool (e.g., 500A) using the machining tool (e.g., 181 in FIG. 1B) integrated with the CMP tool. The arrows 121 in FIG. 8 illustrate the paths of, e.g., the bit 183 of the machining tool 181 (see, e.g., FIG. 1B). In some embodiments, the machine tool is controlled by a computer. Computer programs (e.g., computer code) may be loaded onto the computer to define the patterns of the polishing structures 105, which patterns in turn define the paths (see, e.g., 121) of, e.g., the bit of the machining tool, such that pre-determined amounts of the material of the pad layer 103 may be removed at pre-determined locations to form the polishing structures 105. The pad layer 103 may be referred to as a pad material before machining techniques are used to remove portions thereof to form the polishing structures 105. The paths illustrated by the arrows 121 in FIG. 8 are merely examples. The paths of the machine tool may include any suitable shape (e.g., circles, straight lines, curves) and may extend along any suitable direction (e.g., horizontal or vertical to the upper surface of the pad layer 103). In addition, for polishing structures 105 having complex shapes, more than one machining tools and/or more than one bits may be used at different stages to perform different machining operations, such as turning, drilling, boring, reaming, milling, or the like.

In some embodiments, before being operated on by the machining tool, the pad layer 103 may have a flat upper surface 103U' that is level with, or higher than, the upper surface 105U of the (to be formed) polishing structures 105. In embodiments where the flat upper surface 103U' is higher than the upper surface 105U, the machining tool may remove an upper portion of the pad layer 103 to thin the pad layer 103, such that the flat upper surface 103U' (after thinning) is level with the upper surface 105U. Next, the machining tool removes portions of the upper layer of the pad layer 103 (e.g., along the paths indicated by the arrows 121), and the remaining portions of the upper layer of the pad layer 103 form the polishing structures 105, which comprise one or more line shaped segments extending along the upper surface 103U of the pad layer 103. Therefore, the polishing structures 105 are formed of a same material as the pad layer 103, in the illustrated embodiments. The polishing structures 105 and the pad layer 103 are formed of a homogeneous material (e.g., a thermosetting plastic), in some embodiments. As a result, there is no internal interface between opposing sidewalls 105S (see FIG. 2C) of the polishing structure 105, in some embodiments. In other words, a same material (e.g., a thermosetting plastic) extends continuously without an interface from a first sidewall 105S (e.g., the sidewall 105S on the left in FIG. 2C) to a second sidewall 105S (e.g., the sidewall 105S on the right in FIG. 2C) opposing the first sidewall. After the polishing structures 105 are formed, the upper surface 103U of the pad layer 103 recesses below the upper surface 105U of the polishing structures 105.

In some embodiments, to form a polishing pad, the machining tool receives a bulk material (e.g., a piece of thermosetting plastic) which may not have a flat upper surface (e.g., may have an irregular shape). The machining tool may shape the bulk material (e.g., by removing portions of the bulk material) into a disk shaped pad material 103 with flat upper and lower surfaces, then the machine tool may proceed to form the polishing structures 105 by removing portions of the top layer of the pad material 103, as discussed above. The process of shaping the bulk material into the disk shaped pad material 103 may also be referred to as a process to form a pad material.

Polishing structures 105 with different shapes, such as spiral shaped polishing structures, concentric circle shaped polishing structures, honey comb shaped polishing structures, may be formed using the machining techniques. With computer controlled machining tools, various patterns for the polishing structures 105 may be programmed and easily achieved. This significantly reduces the cost and development cycle for making the polishing pad. For example, the computer controlled machining tools may produce a polishing pad disclosed herein in minutes or hours. Changing the patterns of the polishing structures 105 may be easily done by changing the program (e.g., reprogramming the computer code) of the control computer of the machining tool.

Additionally, a worn out polishing pad (e.g., having polishing structures 105 with the height H smaller than a pre-determined minimum height) may be rejuvenated by a surface re-conditioning process, which uses the machining techniques to further recess the upper surface 103U of the pad layer 103. The re-conditioning process is performed in the CMP tool 500A using the machining tool 181 (see FIG. 1B) of the CMP tool 500A, in some embodiments. In other embodiments, the re-conditioning process is performed outside the CMP tool (e.g., 500) using a machining tool separate from the CMP tool. For example, to re-condition a worn-out polishing pad, the machine machining techniques may be used to remove portions of the upper layer of the pad layer 103 (e.g., along the paths indicated by the arrows 121), following the same paths used to define the patterns of the polishing structure 105 for a new polishing pad. As a result, the shapes and the locations of the polishing structures 105 on the rejuvenated polishing pad remain unchanged before and after the re-conditioning process, and only the upper surface 103U is recessed further to increase the height H of the polishing structures 105. This allows for consistent and repeatable asperity for the polishing pads.

Being able to form the polishing pad using the machining technique is another advantage of the present disclosure. To illustrate, consider a second reference design where a plurality of micro CMP bumps are formed on an upper surface of a polishing pad, wherein the micro CMP bumps comprise cylinder shaped bumps having sizes (e.g., width, height) in the order of microns (e.g., a few microns). The micro CMP bumps may be arranged in arrays (e.g., in rows and columns). Due to the small size of the micro CMP bumps (e.g., a few microns), the micro CMP bumps may extend into the recesses (see, e.g., 117 in FIG. 7A) between high surface portions (see, e.g., 115 in FIG. 7A) and remove the low surface portions (see, e.g., 119 in FIG. 7A), thus causing dishing and erosion of the wafer being polished. In addition, the small size of the micro CMP bumps means that there are millions of micro CMP bumps on the surface of a polishing pad. Such a large number of micro CMP bumps makes it economically unfeasible to use the machining techniques to form the millions of micro CMP bumps. Instead, the micro CMP bumps may have to be formed by a molding process, which may limit the choice of the material for the micro CMP bumps to thermoplastics. However, thermoplastics is a poor choice for a material used in the polishing pad, because thermoplastics becomes pliable (e.g., remelts) as its temperature rises above a specific temperature. Since the CMP process generates temperature cycles (e.g., temperature rises during CMP polishing), the physical properties (e.g., hardness, and/or shape) of the micro CMP bumps made of thermoplastics change as a function of temperature. Therefore, polishing pads with the micro CMP bumps formed of thermoplastics may not provide consistent and repeatable surface asperity and/or CMP polishing rate. Another drawback for using the molding process to form the polishing pad with the micro CMP bumps is the long development cycle, because it usually takes months to make a new mold used for the molding process, thus any design change for the micro CMP bumps will takes months to implement.

In contrast, the presently disclosed polishing pads may be formed by the machining process, which allows any suitable material (e.g., thermosetting plastics) to be used for the polishing pads. For example, thermosetting plastics may be used to form the polishing pads 100A-100D with polishing structure 105. Unlike thermoplastics, thermosetting plastics is a type of plastic that is irreversibly cured from, e.g., a pre-polymer or resin. In other words, once the thermosetting plastics is cured, it does not remelt when temperature rises. Therefore, the presently disclosed polishing pads are formed of a material(s) having stable physical properties (e.g., hardness, and/or shape), thus are able to provide repeatable surface asperity and CMP polishing rate. As discussed above, changing design patterns for the polishing structures 105 takes only minutes or hours using the computer controlled machining tool.

Additional advantages of the presently disclosed polishing pads include low cost production. Recall that the first reference design uses a porous polishing pad, which is more expensive than a solid pad layer such as the pad layer 103 of the polishing pads 100 and 100A-100D.

Figure 9:
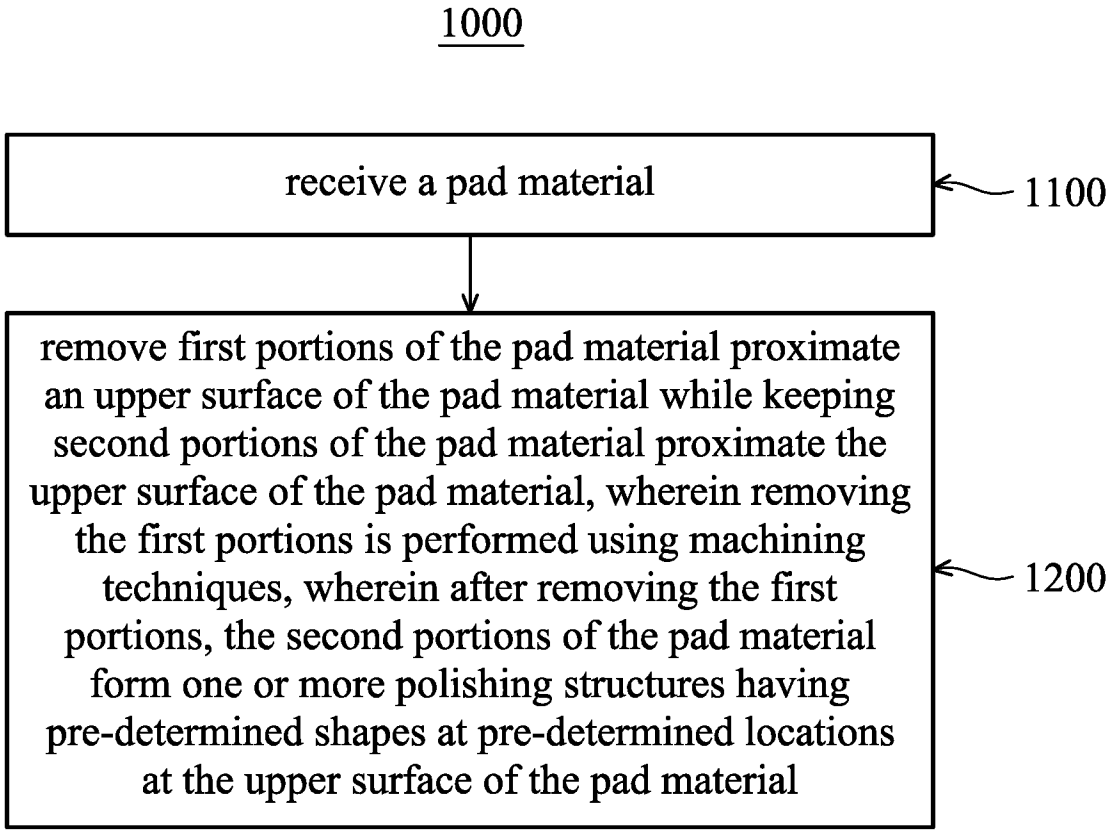
FIG. 9 illustrates a flow chart of a method for manufacturing a polishing pad, in accordance with an embodiment.

FIG. 9 illustrates a flow chart of a method for manufacturing a polishing pad, in accordance with some embodiments. It should be understood that the embodiment method shown in FIG. 9 is merely an example of many possible embodiment methods. One of ordinary skill in the art would recognize many variations, alternatives, and modifications. For example, various steps as illustrated in FIG. 9 may be added, removed, replaced, rearranged and repeated.

Referring to FIG. 9, at step 1100, a pad material is received. At step 1200, first portions of the pad material proximate an upper surface of the pad material is removed while second portion of the pad material proximate the upper surface of the pad material are kept (e.g., remain), wherein removing the first portions is performed using machining techniques, wherein after removing the first portions, the second portions of the pad material form one or more polishing structures having pre-determined shapes at pre-determined locations at the upper surface of the pad material.

In an embodiment, a polishing pad includes a pad layer and one or more polishing structures over an upper surface of the pad layer, where each of the one or more polishing structures has a pre-determined shape and is formed at a pre-determined location of the pad layer, where the one or more polishing structures comprise at least one continuous line shaped segment extending along the upper surface of the pad layer, where each of the one or more polishing structures is a homogeneous material. In an embodiment, in a plan view, the one or more polishing structures are strip shaped, grid shaped, spiral shaped, concentric circle shaped, or honeycomb shaped. In an embodiment, the one or more polishing structures and the pad layer are formed of a thermosetting plastic. In an embodiment, top surfaces of the one or more polishing structures have a first area, where the upper surface of the pad layer has a second area, wherein the first area is about 1% to about 10% of the second area. In an embodiment, each of the one or more polishing structures has a rectangular cross-section. In an embodiment, a width of the rectangular cross-section is between about 0.5 mm and about 5 mm. In an embodiment, each of the one or more polishing structures has a height between about 0.05 mm and about 1 mm. In an embodiment, each of the one or more polishing structures has a length and a width, wherein the length is at least ten times of the width. In an embodiment, the polishing pad further comprises a support layer under the pad layer, the support layer formed of a different material from the pad layer. In an embodiment, a material of the support layer is softer than a material of the pad layer.

In an embodiment, a method for manufacturing a polishing pad includes receiving a pad material; and removing first portions of the pad material proximate an upper surface of the pad material while keeping second portions of the pad material proximate the upper surface of the pad material, where removing the first portions is performed using machining techniques, where after removing the first portions, the second portions of the pad material form one or more polishing structures having pre-determined shapes at pre-determined locations at the upper surface of the pad material. In an embodiment, the second portions of the pad material form at least one continuous line shaped structure. In an embodiment, removing the first portions comprises removing the first portions of the pad material using a machining tool controlled by a computer. In an embodiment, the method further includes using a first bit of the machining tool to form first patterns of the one or more polishing structures, and using a second bit of the machining tool to form second patterns of the one or more polishing structures. In an embodiment, the machining tool is integrated with a chemical mechanical planarization (CMP) tool, and wherein removing the first portions of the pad material is performed in the CMP tool.

In an embodiment, a method for wafer planarization includes holding a wafer in a retaining ring; rotating a polishing pad, the polishing pad comprising one or more polishing structures on a first side of the polishing pad, where each of the one or more polishing structures comprises at least one continuous line shaped segment; and polishing the wafer by pressing the wafer against the one or more polishing structures. In an embodiment, a longitudinal axis of the continuous line shaped segment is parallel to the first side of the polishing pad. In an embodiment, the method further includes after polishing the wafer, polishing additional wafers without re-conditioning the polishing pad. In an embodiment, the method further includes re-conditioning the polishing pad using a machining tool. In an embodiment, numbers, shapes, and locations of the one or more polishing structures remain a same before and after re-conditioning the polishing pad.

In an embodiment, a polishing pad includes a pad layer and one or more polishing structures over an upper surface of the pad layer, wherein each of the one or more polishing structures has a pre-determined shape and is formed at a pre-determined location of the pad layer, wherein the one or more polishing structures include a first polygon shaped structure, a second polygon shaped structure, a third polygon shaped structure, a fourth polygon shaped structure, and a fifth polygon shaped structure in a plan view, wherein the first polygon shaped structure, the second polygon shaped structure, the third polygon shaped structure, the fourth polygon shaped structure, and the fifth polygon shaped structure protrude from and extend along the upper surface of the pad layer, wherein a first side of the first polygon shaped structure, a first side of the second polygon shaped structure, and a first side of the third polygon shaped structure are aligned along a first direction, wherein a second side of the first polygon shaped structure, a first side of the fourth polygon shaped structure, and a first side of the fifth polygon shaped structure are aligned along a second direction, wherein the first direction is perpendicular to the second direction, wherein each of the one or more polishing structures is a homogeneous material, wherein a third side of the first polygon shaped structure is a straight strip in the plan view, wherein the third side of the first polygon shaped structure is a second side of the second polygon shaped structure, wherein a third side of the second polygon shaped structure is a straight strip in the plan view, wherein the third side of the second polygon shaped structure is a second side of the third polygon shaped structure, wherein a fourth side of the first polygon shaped structure is a straight strip in the plan view, wherein the fourth side of the first polygon shaped structure is a second side of the fourth polygon shaped structure, wherein a third side of the fourth polygon shaped structure is a straight strip in the plan view, wherein the third side of the fourth polygon shaped structure is a second side of the fifth polygon shaped structure, wherein each of the one or more polishing structures has a rectangular cross-section with vertical sidewalls, wherein a width of the rectangular cross-section is between 0.5 mm and 5 mm, wherein a total area of top surfaces of the one or more polishing structures in a plan view is a first area, wherein a total area of the upper surface of the pad layer in the plan view is a second area, and wherein the first area is about 1% to about 10% of the second area. In an embodiment, in the plan view, the one or more polishing structures are grid shaped. In an embodiment, the one or more polishing structures and the pad layer are formed of a thermosetting plastic. In an embodiment, the one or more polishing structures and the pad layer have a hardness between about 10 and about 80 according to the Shore D scale. In an embodiment, each of the one or more polishing structures has a height between about 0.05 mm and about 1 mm. In an embodiment, each of the one or more polishing structures has a length and a width, wherein the length is at least ten times of the width. In an embodiment, the polishing pad further includes a support layer under the pad layer, the support layer formed of a different material from the pad layer. In an embodiment, a material of the support layer is softer than a material of the pad layer. In an embodiment, the rectangular cross-section of each of the one or more polishing structures has a same width.

In an embodiment, a method for wafer planarization includes holding a wafer in a retaining ring; rotating a polishing pad, the polishing pad including one or more-polishing structures on a first side of the polishing pad, wherein the first side of the polishing pad faces the wafer, wherein the one or more polishing structures include a first polygon shaped structure, a second polygon shaped structure, a third polygon shaped structure, and a fourth polygon shaped structure in a plan view and protruding from the first side of the polishing pad, wherein a first side of the first polygon shaped structure is a first straight linear strip in the plan view, wherein the first side of the first polygon shaped structure is a first side of the second polygon shaped structure, wherein a second side of the first polygon shaped structure is a second straight linear strip in the plan view, wherein the second side of the first polygon shaped structure is a first side of the third polygon shaped structure, wherein a second side of the third polygon shaped structure is a third straight linear strip in the plan view, wherein the second side of the third polygon shaped structure is a first side of the fourth polygon shaped structure, wherein a second side of the fourth polygon shaped structure is a fourth straight linear strip in the plan view, wherein the second side of the fourth polygon shaped structure is a second side of the second polygon shaped structure, wherein a third side of the second polygon shaped structure is a fifth straight linear strip in the plan view, wherein the third side of the second polygon shaped structure is a third side of the third polygon shaped structure, wherein the first straight linear strip intersects the second straight linear strip, wherein the first straight linear strip has a first longitudinal axis and the second straight linear strip has a second longitudinal axis different than the first longitudinal axis, wherein each of the first straight linear strip, the second straight linear strip, and the fifth straight linear strip includes two parallel sidewalls in the plan view, wherein a first sidewall of the first straight linear strip is in physical contact with a first sidewall of the second straight linear strip, wherein a material of the first straight linear strip extends continuously without an interface from the first sidewall to a second sidewall of the first straight linear strip, wherein the first sidewall of the first straight linear strip is a first sidewall of the first polygon shaped structure, wherein the second sidewall of the first straight linear strip is a first sidewall of the second polygon shaped structure, wherein a material of the second straight linear strip extends continuously without an interface from the first sidewall to a second sidewall of the second straight linear strip, wherein the first sidewall of the second straight linear strip is a second sidewall of the first polygon shaped structure, and wherein the second sidewall of the second straight linear strip is a first sidewall of the third polygon shaped structure, wherein a material of the fifth straight linear strip extends continuously without an interface from a first sidewall to a second sidewall of the fifth straight linear strip, wherein the first sidewall of the fifth straight linear strip is a second sidewall of the second polygon shaped structure, and wherein the second sidewall of the fifth straight linear strip is a second sidewall of the third polygon shaped structure; and polishing the wafer by pressing the wafer against the one or more polishing structures. In an embodiment, the first longitudinal axis and the second longitudinal axis are parallel to the first side of the polishing pad. In an embodiment, the method further includes re-conditioning the polishing pad using a machining tool. In an embodiment, numbers, shapes, and locations of the one or more polishing structures remain a same before and after re-conditioning the polishing pad in a plan view. In an embodiment, wherein a total area of top surfaces of the one or more polishing structures in a plan view is a first area, wherein a total area of a top surface of the polishing pad in the plan view is a second area, and wherein the first area is about 1% to about 10% of the second area. In an embodiment, the first straight linear strip, the second straight linear strip, the third straight linear strip, the fourth straight linear strip, and the fifth straight linear strip have a same width in the plan view.

In an embodiment, a method for wafer planarization using a chemical mechanical planarization (CMP) tool includes rotating a polishing pad of the CMP tool, wherein the polishing pad includes a pad layer and one or more polishing structures over an upper surface of the pad layer, wherein each of the one or more polishing structures has a pre-determined shape and is formed at a pre-determined location of the pad layer, wherein the one or more polishing structures include a first polygon shaped structure, a second polygon shaped structure, and a third polygon shaped structure protruding from and extending along the upper surface of the pad layer in a plan view, wherein a first side of the first polygon shaped structure is a first straight linear strip in the plan view, wherein the first side of the first polygon shaped structure is a first side of the second polygon shaped structure, wherein a second side of the second polygon shaped structure is a second straight linear strip in the plan view, wherein the second side of the second polygon shaped structure is a first side of the third polygon shaped structure, wherein a second side of the third polygon shaped structure is a third straight linear strip in the plan view, wherein the second side of the third polygon shaped structure is a second side of the first polygon shaped structure, wherein the first straight linear strip, the second straight linear strip, and the third straight linear strip have a same thickness in the plan view, wherein a first sidewall of the first straight linear strip is in physical contact with a first sidewall of the second straight linear strip, wherein a second sidewall of the first straight linear strip is in physical contact with a first sidewall of the third straight linear strip, and wherein a second sidewall of the second straight linear strip is in physical contact with a second sidewall of the third straight linear strip, wherein a total area of top surfaces of the one or more polishing structures in a plan view is a first area, wherein a total area of the upper surface of the pad layer in the plan view is a second area, and wherein the first area is about 1% to about 10% of the second area; and polishing a wafer by pressing the wafer against the one or more polishing structures of the polishing pad. In an embodiment, the one or more polishing structures and the pad layer are formed of a same homogeneous pad material, and wherein the one or more polishing structures are formed by removing first portions of the homogeneous pad material using a machining tool. In an embodiment, the homogeneous pad material is a thermosetting plastics. In an embodiment, the method further includes re-conditioning the polishing pad using the machining tool, wherein numbers, shapes, and locations of the one or more polishing structures remain a same before and after re-conditioning the polishing pad in a plan view. In an embodiment, the removing of the first portions of the homogeneous pad material is performed inside the CMP tool prior to the rotating the polishing pad, and wherein the polishing pad remains in the CMP tool after the removing of the first portions of the homogeneous pad material until after the rotating the polishing pad and after the polishing the wafer. In an embodiment, each of the one or more polishing structures has a rectangular cross-section with vertical sidewalls, wherein a width of the rectangular cross-section is between 0.5 mm and 5 mm. In an embodiment, each of the one or more polishing structures has a length, wherein the length is greater than the width of the rectangular cross-section. In an embodiment, a material of the first straight linear strip extends continuously without an interface from the first sidewall to the second sidewall of the first straight linear strip, wherein the first sidewall of the first straight linear strip is a first sidewall of the first polygon shaped structure, wherein the second sidewall of the first straight linear strip is a first sidewall of the second polygon shaped structure, wherein a material of the second straight linear strip extends continuously without an interface from the first sidewall to the second sidewall of the second straight linear strip, wherein the first sidewall of the second straight linear strip is a second sidewall of the second polygon shaped structure, wherein the second sidewall of the second straight linear strip is a first sidewall of the third polygon shaped structure, wherein a material of the third straight linear strip extends continuously without an interface from the first sidewall to the second sidewall of the third straight linear strip, wherein the first sidewall of the third straight linear strip is a second sidewall of the third polygon shaped structure, and wherein the second sidewall of the third straight linear strip is a second sidewall of the first polygon shaped structure.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A polishing pad comprising:

a pad layer; and one or more polishing structures over an upper surface of the pad layer, wherein each of the one or more polishing structures has a pre-determined shape and is formed at a pre-determined location of the pad layer, wherein the one or more polishing structures comprise a first polygon shaped structure, a second polygon shaped structure, a third polygon shaped structure, a fourth polygon shaped structure, and a fifth polygon shaped structure in a plan view, wherein the first polygon shaped structure, the second polygon shaped structure, the third polygon shaped structure, the fourth polygon shaped structure, and the fifth polygon shaped structure protrude from and extend along the upper surface of the pad layer, wherein a first side of the first polygon shaped structure, a first side of the second polygon shaped structure, and a first side of the third polygon shaped structure are aligned along a first direction, wherein a second side of the first polygon shaped structure, a first side of the fourth polygon shaped structure, and a first side of the fifth polygon shaped structure are aligned along a second direction, wherein the first direction is perpendicular to the second direction, wherein each of the one or more polishing structures is a homogeneous material, wherein a third side of the first polygon shaped structure is a straight strip in the plan view, wherein the third side of the first polygon shaped structure is a second side of the second polygon shaped structure, wherein a third side of the second polygon shaped structure is a straight strip in the plan view, wherein the third side of the second polygon shaped structure is a second side of the third polygon shaped structure, wherein a fourth side of the first polygon shaped structure is a straight strip in the plan view, wherein the fourth side of the first polygon shaped structure is a second side of the fourth polygon shaped structure, wherein a third side of the fourth polygon shaped structure is a straight strip in the plan view, wherein the third side of the fourth polygon shaped structure is a second side of the fifth polygon shaped structure, wherein each of the one or more polishing structures has a rectangular cross-section with vertical sidewalls, wherein a width of the rectangular cross-section is between 0.5 mm and 5 mm, wherein a total area of top surfaces of the one or more polishing structures in a plan view is a first area, wherein a total area of the upper surface of the pad layer in the plan view is a second area, and wherein the first area is about 1% to about 10% of the second area.

2. The polishing pad of claim 1, wherein in the plan view, the one or more polishing structures are grid shaped.

3. The polishing pad of claim 1, wherein the one or more polishing structures and the pad layer are formed of a thermosetting plastic.

4. The polishing pad of claim 1, wherein each of the one or more polishing structures has a height between about 0.05 mm and about 1 mm.

5. The polishing pad of claim 1, wherein each of the one or more polishing structures has a length and a width, wherein the length is at least ten times of the width.

6. The polishing pad of claim 1, further comprising a support layer under the pad layer, the support layer formed of a different material from the pad layer.

7. The polishing pad of claim 6, wherein a material of the support layer is softer than a material of the pad layer.

8. The polishing pad of claim 3, wherein the one or more polishing structures and the pad layer have a hardness between about 10 and about 80 according to the Shore D scale.

9. The polishing pad of claim 1, wherein the rectangular cross-section of each of the one or more polishing structures has a same width.

10. A method for wafer planarization, the method comprising:

holding a wafer in a retaining ring;

rotating a polishing pad, the polishing pad comprising one or more polishing structures on a first side of the polishing pad, wherein the first side of the polishing pad faces the wafer, wherein the one or more polishing structures comprise a first polygon shaped structure, a second polygon shaped structure, a third polygon shaped structure, and a fourth polygon shaped structure in a plan view and protruding from the first side of the polishing pad, wherein a first side of the first polygon shaped structure is a first straight linear strip in the plan view, wherein the first side of the first polygon shaped structure is a first side of the second polygon shaped structure, wherein a second side of the first polygon shaped structure is a second straight linear strip in the plan view, wherein the second side of the first polygon shaped structure is a first side of the third polygon shaped structure, wherein a second side of the third polygon shaped structure is a third straight linear strip in the plan view, wherein the second side of the third polygon shaped structure is a first side of the fourth polygon shaped structure, wherein a second side of the fourth polygon shaped structure is a fourth straight linear strip in the plan view, wherein the second side of the fourth polygon shaped structure is a second side of the second polygon shaped structure, wherein a third side of the second polygon shaped structure is a fifth straight linear strip in the plan view, wherein the third side of the second polygon shaped structure is a third side of the third polygon shaped structure, wherein the first straight linear strip intersects the second straight linear strip, wherein the first straight linear strip has a first longitudinal axis and the second straight linear strip has a second longitudinal axis different than the first longitudinal axis, wherein each of the first straight linear strip, the second straight linear strip, and the fifth straight linear strip comprises two parallel sidewalls in the plan view, wherein a first sidewall of the first straight linear strip is in physical contact with a first sidewall of the second straight linear strip, wherein a material of the first straight linear strip extends continuously without an interface from the first sidewall to a second sidewall of the first straight linear strip, wherein the first sidewall of the first straight linear strip is a first sidewall of the first polygon shaped structure, wherein the second sidewall of the first straight linear strip is a first sidewall of the second polygon shaped structure, wherein a material of the second straight linear strip extends continuously without an interface from the first sidewall to a second sidewall of the second straight linear strip, wherein the first sidewall of the second straight linear strip is a second sidewall of the first polygon shaped structure, and wherein the second sidewall of the second straight linear strip is a first sidewall of the third polygon shaped structure, wherein a material of the fifth straight linear strip extends continuously without an interface from a first sidewall to a second sidewall of the fifth straight linear strip, wherein the first sidewall of the fifth straight linear strip is a second sidewall of the second polygon shaped structure, and wherein the second sidewall of the fifth straight linear strip is a second sidewall of the third polygon shaped structure; and polishing the wafer by pressing the wafer against the one or more polishing structures.

11. The method of claim 10, wherein the first longitudinal axis and the second longitudinal axis are parallel to the first side of the polishing pad.

12. The method of claim 10, further comprising re-conditioning the polishing pad using a machining tool.

13. The method of claim 12, wherein numbers, shapes, and locations of the one or more polishing structures remain a same before and after re-conditioning the polishing pad in a plan view.

14. The method of claim 10, wherein a total area of top surfaces of the one or more polishing structures in a plan view is a first area, wherein a total area of a top surface of the polishing pad in the plan view is a second area, and wherein the first area is about 1% to about 10% of the second area.

15. The method of claim 10, wherein the first straight linear strip, the second straight linear strip, the third straight linear strip, the fourth straight linear strip, and the fifth straight linear strip have a same width in the plan view.

16. A method for wafer planarization using a chemical mechanical planarization (CMP) tool, the method comprising:

rotating a polishing pad of the CMP tool, wherein the polishing pad comprises a pad layer and one or more polishing structures over an upper surface of the pad layer, wherein each of the one or more polishing structures has a pre-determined shape and is formed at a pre-determined location of the pad layer, wherein the one or more polishing structures comprise a first polygon shaped structure, a second polygon shaped structure, and a third polygon shaped structure protruding from and extending along the upper surface of the pad layer in a plan view, wherein a first side of the first polygon shaped structure is a first straight linear strip in the plan view, wherein the first side of the first polygon shaped structure is a first side of the second polygon shaped structure, wherein a second side of the second polygon shaped structure is a second straight linear strip in the plan view, wherein the second side of the second polygon shaped structure is a first side of the third polygon shaped structure, wherein a second side of the third polygon shaped structure is a third straight linear strip in the plan view, wherein the second side of the third polygon shaped structure is a second side of the first polygon shaped structure, wherein the first straight linear strip, the second straight linear strip, and the third straight linear strip have a same thickness in the plan view, wherein a first sidewall of the first straight linear strip is in physical contact with a first sidewall of the second straight linear strip, wherein a second sidewall of the first straight linear strip is in physical contact with a first sidewall of the third straight linear strip, and wherein a second sidewall of the second straight linear strip is in physical contact with a second sidewall of the third straight linear strip, wherein a total area of top surfaces of the one or more polishing structures in a plan view is a first area, wherein a total area of the upper surface of the pad layer in the plan view is a second area, and wherein the first area is about 1% to about 10% of the second area; and polishing a wafer by pressing the wafer against the one or more polishing structures of the polishing pad.

17. The method of claim 16, wherein the one or more polishing structures and the pad layer are formed of a same homogeneous pad material, and wherein the one or more polishing structures are formed by removing first portions of the homogeneous pad material using a machining tool.

18. The method of claim 17, wherein the homogeneous pad material is a thermosetting plastics.

19. The method of claim 17, further comprising reconditioning the polishing pad using the machining tool, wherein numbers, shapes, and locations of the one or more polishing structures remain a same before and after reconditioning the polishing pad in a plan view.

20. The method of claim 17, wherein the removing of the first portions of the homogeneous pad material is performed inside the CMP tool prior to the rotating the polishing pad, and wherein the polishing pad remains in the CMP tool after the removing of the first portions of the homogeneous pad material until after the rotating the polishing pad and after the polishing the wafer.

21. The method of claim 16, wherein each of the one or more polishing structures has a rectangular cross-section with vertical sidewalls, wherein a width of the rectangular cross-section is between 0.5 mm and 5 mm.

22. The method of claim 21, wherein each of the one or more polishing structures has a length, wherein the length is greater than the width of the rectangular cross-section.

23. The method of claim 21, wherein a material of the first straight linear strip extends continuously without an interface from the first sidewall to the second sidewall of the first straight linear strip, wherein the first sidewall of the first straight linear strip is a first sidewall of the first polygon shaped structure, wherein the second sidewall of the first straight linear strip is a first sidewall of the second polygon shaped structure, wherein a material of the second straight linear strip extends continuously without an interface from the first sidewall to the second sidewall of the second straight linear strip, wherein the first sidewall of the second straight linear strip is a second sidewall of the second polygon shaped structure, wherein the second sidewall of the second straight linear strip is a first sidewall of the third polygon shaped structure, wherein a material of the third straight linear strip extends continuously without an interface from the first sidewall to the second sidewall of the third straight linear strip, wherein the first sidewall of the third straight linear strip is a second sidewall of the third polygon shaped structure, and wherein the second sidewall of the third straight linear strip is a second sidewall of the first polygon shaped structure.

* * * * *